US009610669B2

(12) United States Patent
Walsh et al.

(10) Patent No.: US 9,610,669 B2
(45) Date of Patent: Apr. 4, 2017

(54) METHODS AND SYSTEMS FOR USE IN GRIND SPINDLE ALIGNMENT

(71) Applicant: Strasbaugh, San Luis Obispo, CA (US)

(72) Inventors: Thomas A. Walsh, Atascadero, CA (US); Larry A. Spiegel, Atascadero, CA (US)

(73) Assignee: Strasbaugh, San Luis Obispo, CA (US)

( * ) Notice: Subject to any disclaimer, the term of this patent is extended or adjusted under 35 U.S.C. 154(b) by 124 days.

(21) Appl. No.: 14/042,600

(22) Filed: Sep. 30, 2013

(65) Prior Publication Data

US 2014/0134927 A1 May 15, 2014

Related U.S. Application Data

(60) Provisional application No. 61/708,165, filed on Oct. 1, 2012.

(51) Int. Cl.
*B24B 7/22* (2006.01)

(52) U.S. Cl.
CPC ..... *B24B 7/228* (2013.01)

(58) Field of Classification Search
CPC ..... B24B 17/00; B24B 51/00; B24B 49/04
USPC ..... 451/5–10, 360
See application file for complete search history.

(56) References Cited

U.S. PATENT DOCUMENTS

| | | | | |
|---|---|---|---|---|
| 2,665,589 | A | | 1/1954 | Rusher |
| 2,968,133 | A | | 1/1961 | Reichardt |
| 3,142,942 | A | | 8/1964 | Celovsky |
| 3,715,841 | A | * | 2/1973 | Schnellman et al. ..... 451/22 |
| 3,885,925 | A | | 5/1975 | Tatar |
| 4,109,552 | A | | 8/1978 | Imoberdorf |
| 4,897,362 | A | | 1/1990 | Delgado |
| 5,067,085 | A | | 11/1991 | Wenzel |
| 5,240,883 | A | | 8/1993 | Abe |
| 5,718,619 | A | | 2/1998 | Merrill |
| 5,964,646 | A | | 10/1999 | Kassir et al. |
| 6,090,688 | A | | 7/2000 | Ogawa |
| 6,190,234 | B1 | | 2/2001 | Swedek |
| 6,254,155 | B1 | | 7/2001 | Kassir |
| 6,336,849 | B1 | | 1/2002 | Konnemann |
| 6,343,980 | B1 | | 2/2002 | Abe |

(Continued)

FOREIGN PATENT DOCUMENTS

| | | |
|---|---|---|
| JP | 2006120757 | 5/2006 |
| WO | 2013059705 | 4/2013 |
| WO | 2013106777 | 7/2013 |

OTHER PUBLICATIONS

USPTO; Non-final office action from U.S. Appl. No. 13/656,514, filed Jul. 24, 2014; 25 pgs.

(Continued)

*Primary Examiner* — Larry E Waggle, Jr.
*Assistant Examiner* — Lauren Beronja
(74) *Attorney, Agent, or Firm* — Fitch, Even, Tabin & Flannery LLP

(57) ABSTRACT

A grinding engine includes a work spindle; a work chuck cooperated with the work spindle; a grind spindle; a grind wheel cooperated with the grind spindle; and a plurality of alignment adjustment systems positioned relative to and around the grind spindle, wherein adjustment from any one of the alignment adjustment systems is configured to cause a change in alignment between the work spindle and the grind spindle.

15 Claims, 16 Drawing Sheets

(56) References Cited

U.S. PATENT DOCUMENTS

| | | | | |
|---|---|---|---|---|
| 6,386,956 | B1 | 5/2002 | Sato | |
| 6,402,589 | B1 | 6/2002 | Inaba et al. | |
| 6,534,384 | B2 | 3/2003 | Nakano | |
| 6,624,047 | B1 | 9/2003 | Sakaguchi | |
| 6,638,389 | B2 | 10/2003 | Kassir et al. | |
| 6,866,564 | B2 | 3/2005 | Strasbaugh et al. | |
| 6,976,901 | B1 | 12/2005 | Halley et al. | |
| 7,004,818 | B1 | 2/2006 | Haney | |
| 7,014,540 | B2 * | 3/2006 | Nagel | B24B 7/16 451/268 |
| 7,018,268 | B2 | 3/2006 | Kassir et al. | |
| 7,022,000 | B2 | 4/2006 | Mizomoto et al. | |
| 7,059,942 | B2 | 6/2006 | Strasbaugh et al. | |
| 7,118,446 | B2 | 10/2006 | Walsh et al. | |
| 7,160,808 | B2 | 1/2007 | Kassir | |
| 7,402,093 | B2 * | 7/2008 | Sjolander et al. | 451/5 |
| 7,458,878 | B2 | 12/2008 | Walsh et al. | |
| 8,133,093 | B2 | 3/2012 | Vogtmann et al. | |
| 8,520,222 | B2 | 8/2013 | Schraub et al. | |
| 8,968,052 | B2 | 3/2015 | Walsh | |
| 2001/0002359 | A1 | 5/2001 | Matsuo | |
| 2002/0006768 | A1 | 1/2002 | Wada et al. | |
| 2002/0042243 | A1 | 4/2002 | Ihsikawa | |
| 2002/0102144 | A1 * | 8/2002 | Linderholm | B23B 35/00 409/191 |
| 2002/0127950 | A1 | 9/2002 | Hirose | |
| 2003/0124961 | A1 | 7/2003 | Haney | |
| 2003/0232581 | A1 | 12/2003 | Ki | |
| 2004/0011462 | A1 | 1/2004 | Gotkis et al. | |
| 2004/0053500 | A1 | 3/2004 | Shemer | |
| 2004/0063385 | A1 | 4/2004 | Perlov | |
| 2004/0124509 | A1 | 7/2004 | Kim | |
| 2005/0026543 | A1 | 2/2005 | Han | |
| 2005/0176350 | A1 | 8/2005 | Gerber | |
| 2005/0227587 | A1 | 10/2005 | Yang | |
| 2006/0194513 | A1 * | 8/2006 | Saxler | B23B 31/36 451/8 |
| 2007/0128983 | A1 | 6/2007 | Walsh et al. | |
| 2008/0090505 | A1 | 4/2008 | Yoshida | |
| 2009/0203299 | A1 | 8/2009 | Kashiwa | |
| 2010/0285665 | A1 | 11/2010 | Takai et al. | |
| 2011/0014774 | A1 | 1/2011 | Johnson | |
| 2012/0239182 | A1 | 9/2012 | Kikata | |
| 2013/0102227 | A1 | 4/2013 | Walsh et al. | |
| 2013/0130593 | A1 | 5/2013 | Kalenian et al. | |

OTHER PUBLICATIONS

Sony; "Digital Gauge Measuring Unit DK Series"; Catalog #497; 2005; 2 Pages.

Heidenhain Encoders; "Heidenhain Magnetic Modular Encoders" Internet Catalog; At least Jul. 2011; 1 Page.

THK; "Features of the Cross-Roller Ring—THK Technical Support"; Published before Oct. 2011; 3 Pages.

Tamar Technology; WTS Optical Head; Published before Oct. 21, 2011; 4 Pages.

Tamar Technology; Reference Manual for Wafer Thickness Sensor <WTS) WinSock Server; Version 1.0; Feb. 15, 2011; 23 Pages.

PCT; Notification of Transmittal of the International Search Report and the Written Opinion of the International Searching Authority issued in International Patent Application No. PCT/US2012/061169; Mailed Mar. 8, 2013; 2 pages.

PCT; International Search Report issued in International Patent Application No. PCT/US2012/061169; Mailed Mar. 8, 2013; 3 pages.

PCT; Written Opinion of the International Searching Authority issued in International Patent Application No. PCT/US2012/061169; Mailed Mar. 8, 2013; 4 pages.

PCT; Notification of Transmittal of the International Search Report and the Written Opinion of the International Searching Authority issued in International Patent Application No. PCT/US2013/021319; Mailed Mar. 19, 2013; 2 pages.

PCT; International Search Report issued in International Patent Application No. PCT/US2013/021319; Mailed Mar. 19, 2013; 2 pages.

PCT; Written Opinion of the International Searching Authority issued in International Patent Application No. PCT/US2013/021319; Mailed Mar. 19, 2013; 4 pages.

Brake et al.; U.S. Appl. No. 14/042,591, filed Sep. 30, 2013; 39 Pages.

USPTO; Notice of Allowance from U.S. Appl. No. 13/656,514 mailed Oct. 30, 2014.

USPTO: Restriction Requirement issued in U.S. Appl. No. 14/042,591 mailed Feb. 9, 2015.

USPTO; Non-Final Office Action from U.S. Appl. No. 14/042,591 mailed Jun. 15, 2015.

USPTO; Non-Final Office Action from U.S. Appl. No. 13/740,101 mailed Nov. 2, 2015.

USPTO; Notice of Allowance from U.S. Appl. No. 14/042,591 mailed Jun. 3, 2016.

Puligadda et al.; "High-Performance Temporary Adhesives for Wafer Bonding Applications"; Enabling Technologies for 3-D Integration; Mater. Res. Soc. Symp. Proc. vol. 970; 2007; 18 pages.

USPTO; Final Office Action from U.S. Appl. No. 14/042,591 mailed Dec. 18, 2015.

USPTO; Notice of Allowance from U.S. Appl. No. 13/740,101 mailed Mar. 11, 2016.

USPTO; Notice of Allowance from U.S. Appl. No. 14/042,591 mailed Apr. 7, 2016.

* cited by examiner

| µm | mm | |
|---|---|---|
| = 260756 | = 261 | chuck dressing, grind wheel, diameter |
| = 275565 | = 276 | wafer grind, grind wheel, diameter |
| = 300000 | = 300 | diameter of wafer |

Dressing

| rad | deg | |
|---|---|---|
| = 0.0000000 | = 0.0000 | chuck dressing, upper spindle pitch, for(+) / aft(-) |
| = 0.0000000 | = 0.0000 | chuck dressing, upper spindle roll, left(+) / right(-) |
| µm | deg | |
| 0.0 | 0 | chuck dressing, left front spindle adjust |
| 0.0 | 0 | chuck dressing, right front spindle adjust |

Grind

| rad | deg | |
|---|---|---|
| =-0.0000175 | =-0.0010 | wafer grind, upper spindle pitch, for(+) / aft(-) |
| =-0.0000175 | =-0.0010 | wafer grind, upper spindle roll, left(+) / right(-) |
| µm | deg | |
| 0.9 | 1 | wafer grind, left front spindle adjust |
| 12.5 | 15 | wafer grind, right front spindle adjust |

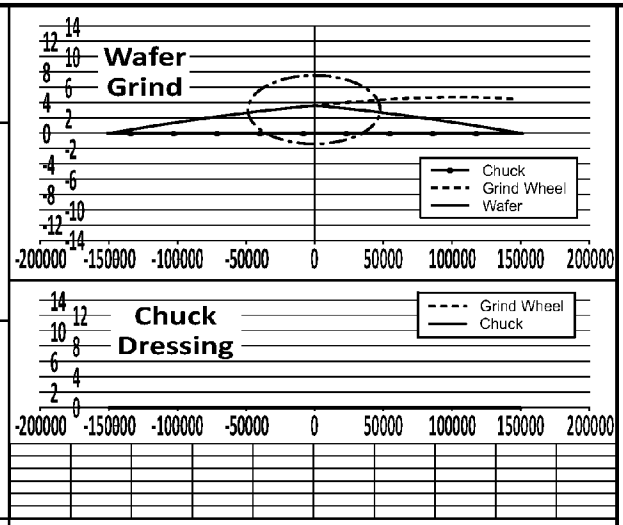

| µm | mm | |
|---|---|---|
| = 260756 | = 261 | chuck dressing, grind wheel, diameter |
| = 275565 | = 276 | wafer grind, grind wheel, diameter |
| = 300000 | = 300 | diameter of wafer |

Dressing

| rad | deg | |
|---|---|---|
| = 0.0000000 | = 0.0000 | chuck dressing, upper spindle pitch, for(+) / aft(-) |
| = 0.0000000 | = 0.0000 | chuck dressing, upper spindle roll, left(+) / right(-) |
| µm | deg | |
| 0 | 0 | chuck dressing, left front spindle adjust |
| 0 | 0 | chuck dressing, right front spindle adjust |

Grind

| rad | deg | |
|---|---|---|
| =-0.0000349 | =-0.0020 | wafer grind, upper spindle pitch, for(+) / aft(-) |
| =-0.0000349 | =-0.0020 | wafer grind, upper spindle roll, left(+) / right(-) |
| µm | deg | |
| 1.8 | 2 | wafer grind, left front spindle adjust |
| 25.1 | 30 | wafer grind, right front spindle adjust |

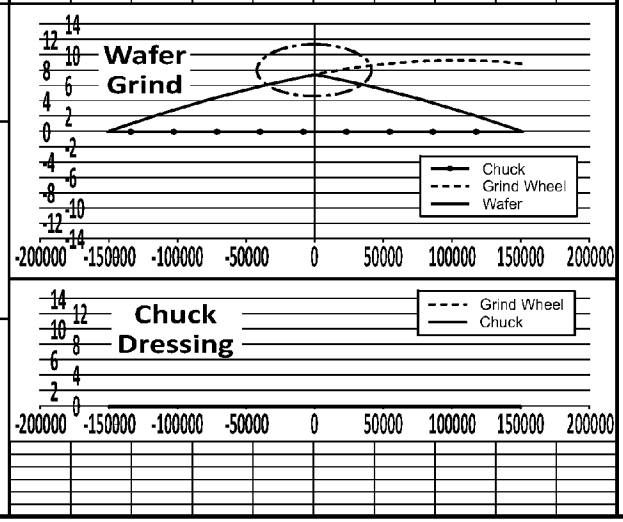

Effect of Grind Spindle Alignment on Ground Wafer Shape

> This computer simulation model shows the effect of changing the Grind Spindle alignment 0.001 degrees about two axes.

> For this example, the work chuck is flat in both cases.

> Note that this small change in spindle alignment causes wafer center thickness to increase about 3 microns (refer to the area highlighted by the hatched red circles).

*FIG. 2*

METHODS AND SYSTEMS FOR USE IN GRIND SPINDLE ALIGNMENT

This application claims the benefit of U.S. Provisional Application No. 61/708,165, filed Oct. 1, 2012, for METHODS AND SYSTEMS FOR USE IN GRIND SPINDLE ALIGNMENT, which is incorporated in its entirety herein by reference.

BRIEF DESCRIPTION OF THE DRAWINGS

The features, benefits and advantages of several embodiments of the present invention will be more apparent from the following more particular description thereof, presented in conjunction with the following drawings.

FIG. 2 shows how changes in grind spindle to work chuck spindle angle cause changes to a wafer surface profile.

Figure 1:
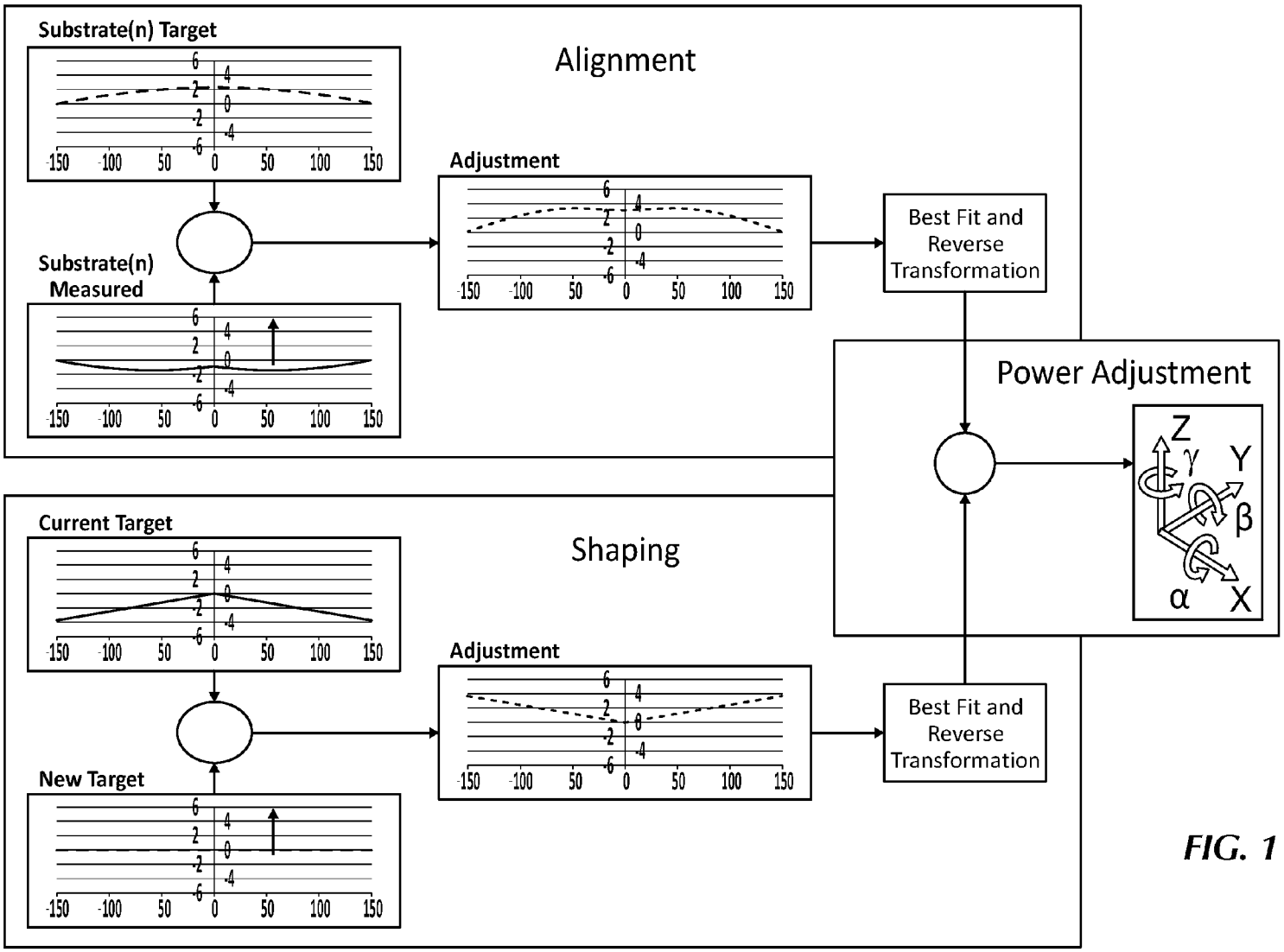
FIG. 1 shows graphical representations of examples of the effects of changing the relative planes of a grind wheel and a chuck.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," "some embodiments," "some implementations" or similar language means that a particular feature, structure, or characteristic described in connection with the embodiment is included in at least one embodiment of the present invention. Thus, appearances of the phrases "in one embodiment," "in an embodiment," "in some embodiments," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Many semiconductor devices, such as miniature semiconductor and related devices, are commonly manufactured using wafers (e.g., round, flat wafers) typically made from single-crystal materials (e.g., silicon). In many instances, during the manufacturing process these wafers are subject to surfacing in an attempt to obtain extremely flat, smooth, and uniform surface-finish conditions. Grinding is typically done with wafer grinders. Some wafer grinders move or plunge a rotating abrasive grinder (e.g., a diamond abrasive cup-shaped grind wheel) onto the top surface of a wafer. In many applications the wafer is also rotating while being held against a work chuck with a precise surface profile. Relative alignment of the grinding abrasive to the wafer determines the post-grind wafer shape and profile of the ground surface of the wafer. In many instances, the flatness of a surface (or other desired surface profile) of the wafer or other work product can be critical to subsequent processing of the wafer, such as with integrated circuit (IC) processing.

Grind spindle alignment to the wafer surface plane is often a critical variable that affects post-grind wafer surface profile. For example, the relative alignment of the wafer surface plane and the plane defined by abrasive elements on a grind wheel can be one of the major contributors to the resulting wafer surface profile. The wafer surface profile is determined, at least in part, by the surface profile of the chuck to which the wafer is positioned during grinding (and often firmly attached, e.g., by vacuum applied through a porous ceramic chuck). Some embodiments employ a grind wheel, where the grind wheel plane is determined by the alignment of the rotating spindle axis that rotates the grind wheel with its attached abrasive elements.

FIG. 1 provides graphical representations of examples of the effects of changing the relative planes of a grind wheel and a chuck. FIG. 2 shows (via computer simulation) how a very slight change in grind spindle to work chuck spindle angle causes a significant change in wafer surface profile. In the example simulations shown in FIG. 2, the change of the grind spindle alignment from the first simulation to the second simulation is about 0.001 degrees about two axes (from about −0.0010 degrees pitch to about −0.002 degrees pitch; and from about −0.0010 roll to about −0.002 roll). For this example, the work chuck is flat in both simulations. Note that this small change in spindle alignment causes wafer center thickness to increase by about 3 microns in the second simulation (refer to the area highlighted by the hatched circles). Some embodiments utilize the processes, systems and apparatuses described in U.S. Provisional Application No. 61/708,146, filed Oct. 1, 2012, entitled METHODS AND SYSTEMS FOR USE IN GRIND SHAPE CONTROL ADAPTATION, which is incorporated herein by reference in its entirety, in determining surface profiles and adjustments of alignment. This analytical procedure predicts a wafer surface profile from given changes in grind spindle alignment and chuck shape and/or surface profile to facilitate achieving the resulting desired wafer surface profile.

Figure 3A:
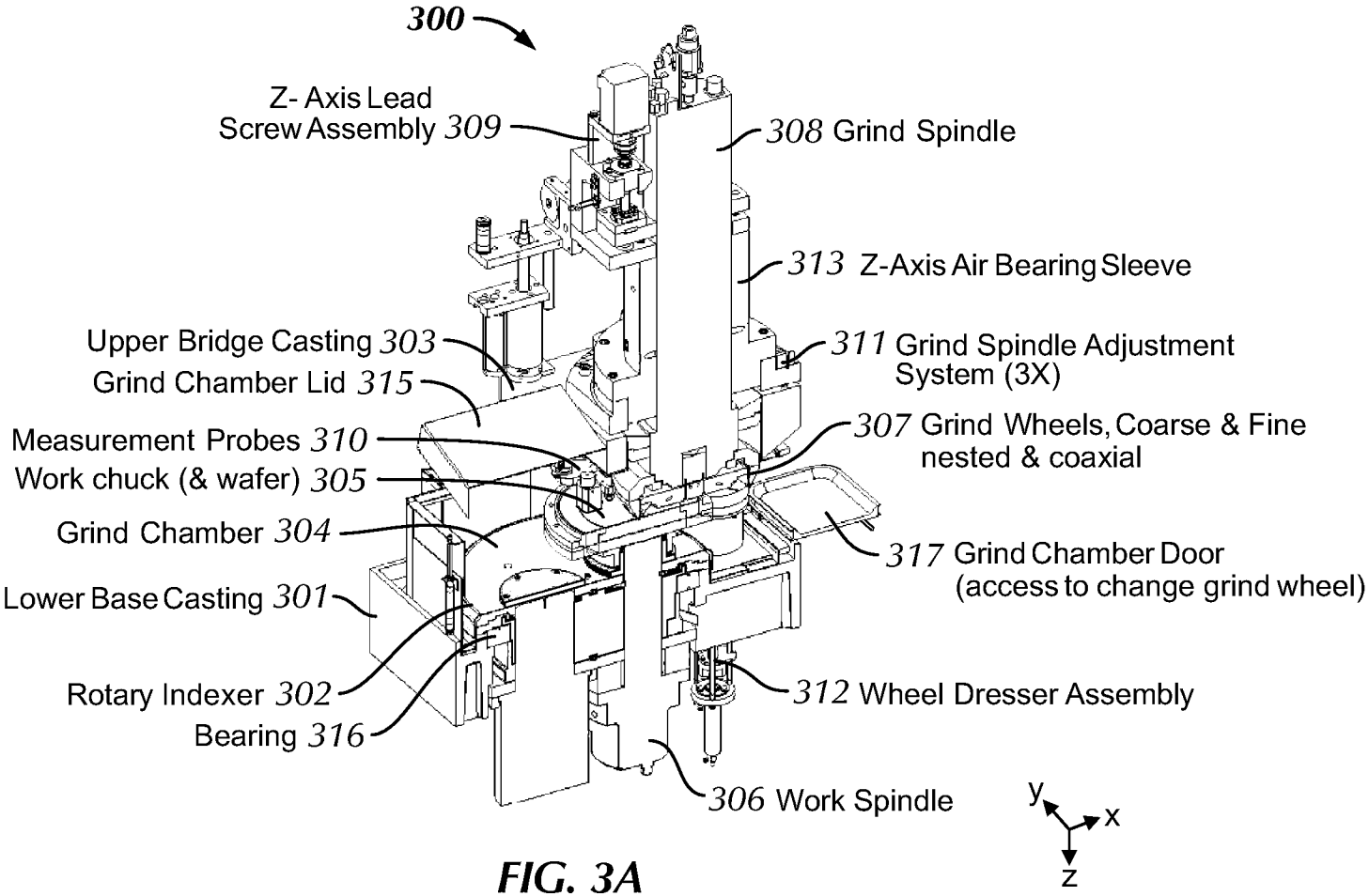
FIG. 3A depicts a simplified, partial cross-sectional and partial cut-away view of a grinding system or engine in accordance with some embodiments.

FIG. 3A depicts a simplified, partial cross-sectional and partial cut-away view of a grinding system or engine 300 in accordance with some embodiments. The grinding engine can be used in grinding and/or polishing of wafers or other work objects. Some configurations provide relatively compact grinding systems or engines.

Figure 4A:
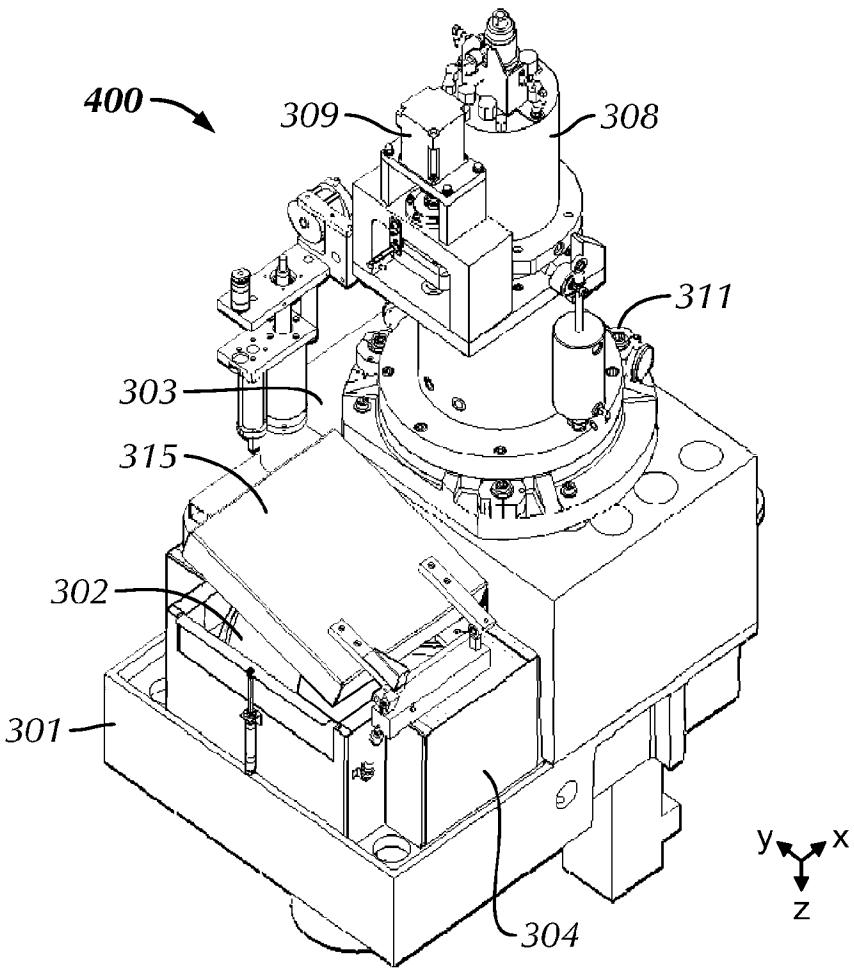
FIG. 4A shows a perspective view of the grinding engine of FIG. 3A.

FIG. 4A shows a perspective view of a grinding engine 400 according to some embodiments. Some embodiments employ the grind engine described in U.S. Provisional Application No. 61/549,787, filed Oct. 21, 2011, to Walsh et al., entitled SYSTEMS AND METHODS OF WAFER GRINDING, which is incorporated herein by reference in its entirety. Referring to FIGS. 3A and 4A, the grinding engines 300, 400, in some embodiments, can comprise some or all of the following elements and assemblies: a lower base casting 301; a rotary indexer 302; an upper bridge casting 303; a grind chamber 304; one or more work chucks 305 and work spindles 306; one or more grind wheels 307 and coaxial grind spindle 308; z-axis lead screw assembly 309; one or more measurement probes 310; one or more spindle alignment adjustment systems or units 311; a wheel dresser 312; z-axis air bearing sleeve and/or spindle housing 313; one or more grind chamber lids or closures 315; one or more bearings 316; one or more grind chamber doors 317; and other relevant components.

Figure 3B:
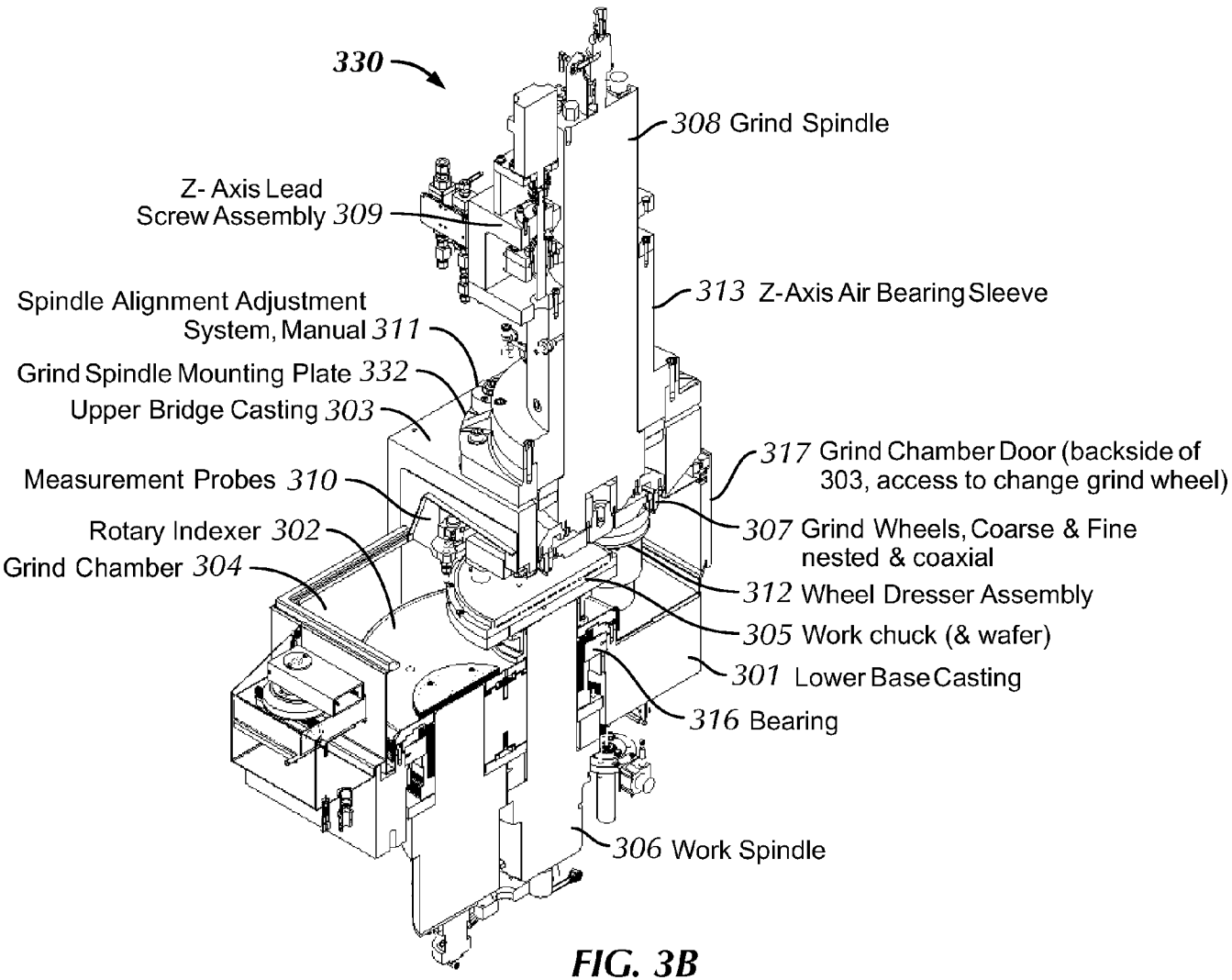
FIG. 3B depicts a simplified, partial cross-sectional and partial cut-away view of a grinding system or engine in accordance with other embodiments.

FIG. 3B depicts a simplified, partial cross-sectional and partial cut-away view of a grinding system or engine 330 in accordance with some embodiments. Similar to the grinding engine 300 of FIG. 3A, the grinding engine 330 can be used in grinding and/or polishing of wafers or other work objects.

Figure 4B:
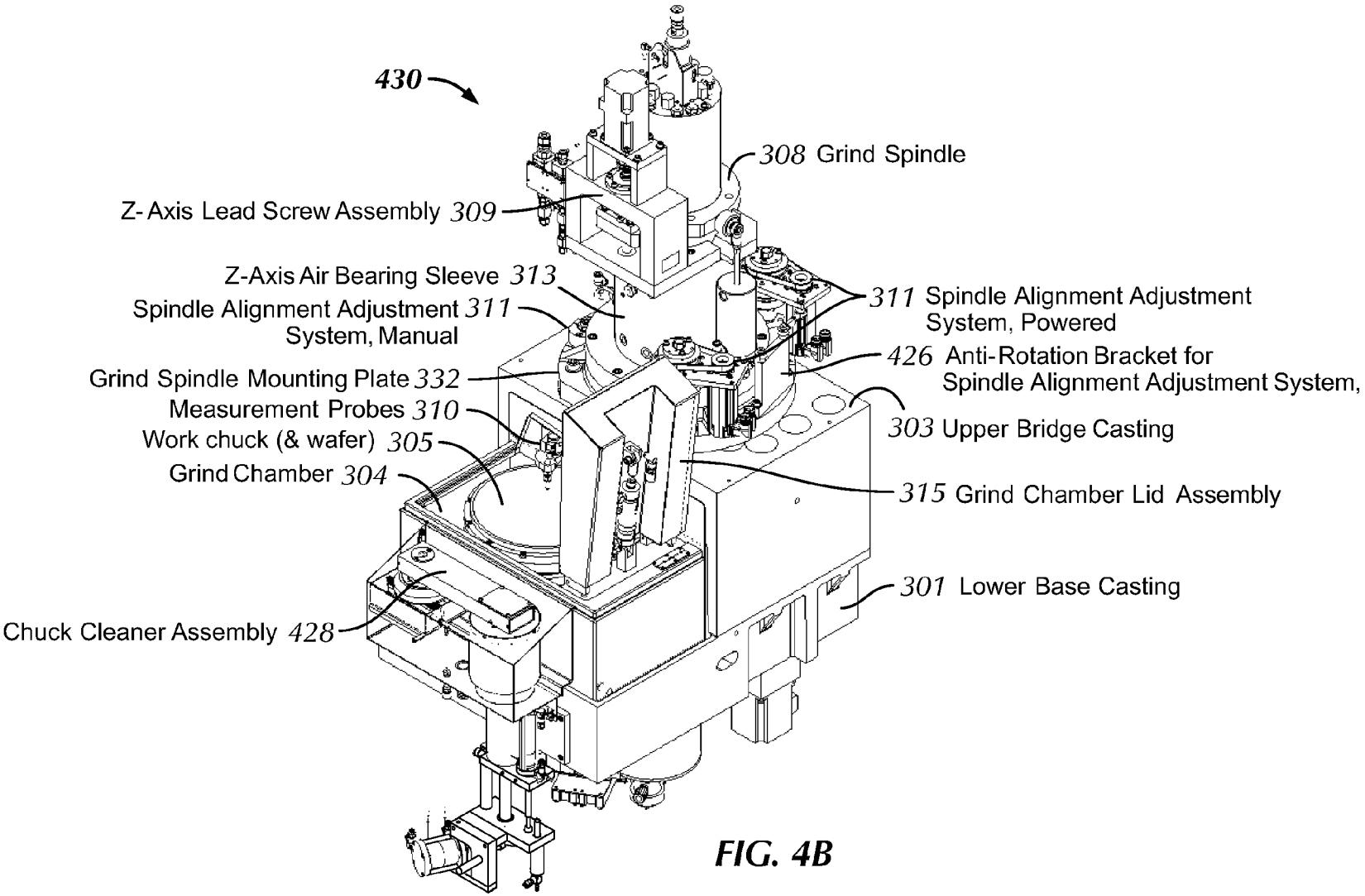
FIG. 4B shows a perspective view of the grinding engine of FIG. 3B.

FIG. 4B shows a perspective view of a grinding engine 430 in accordance with some embodiments. Referring to FIGS. 3B and 4B, the grinding engines 330, 430, similar to the grinding engines 300, 400, can include some or all of the following elements and assemblies: a lower base casting 301; a rotary indexer 302; an upper bridge casting 303; a grind chamber 304; one or more work chucks 305 and work spindles 306; one or more grind wheels 307 and coaxial grind spindle 308; z-axis lead screw assembly 309; one or more measurement probes 310; one or more spindle alignment adjustment systems or units 311; a wheel dresser 312; z-axis air bearing sleeve and/or spindle housing 313; one or more grind chamber lids or closures 315; one or more bearings 316; one or more grind chamber doors 317; the grind spindle mounting plate 332; an anti-rotation bracket 426; chuck cleaner assembly 428; and other relevant components. The grind engines 300, 330, 400 and/or 430 can be incorporated into a grind system that processes wafers or other such objects. For example, grind engines 300, 330, 400 and/or 430 can be incorporated into a grind system and/or utilized in accordance with the processing described in U.S. Application No. 61/585,643, filed Jan. 11, 2012, entitled SYSTEMS AND METHODS OF PROCESSING SUBSTRATES, which is incorporated herein by reference in its entirety.

Figure 4C:
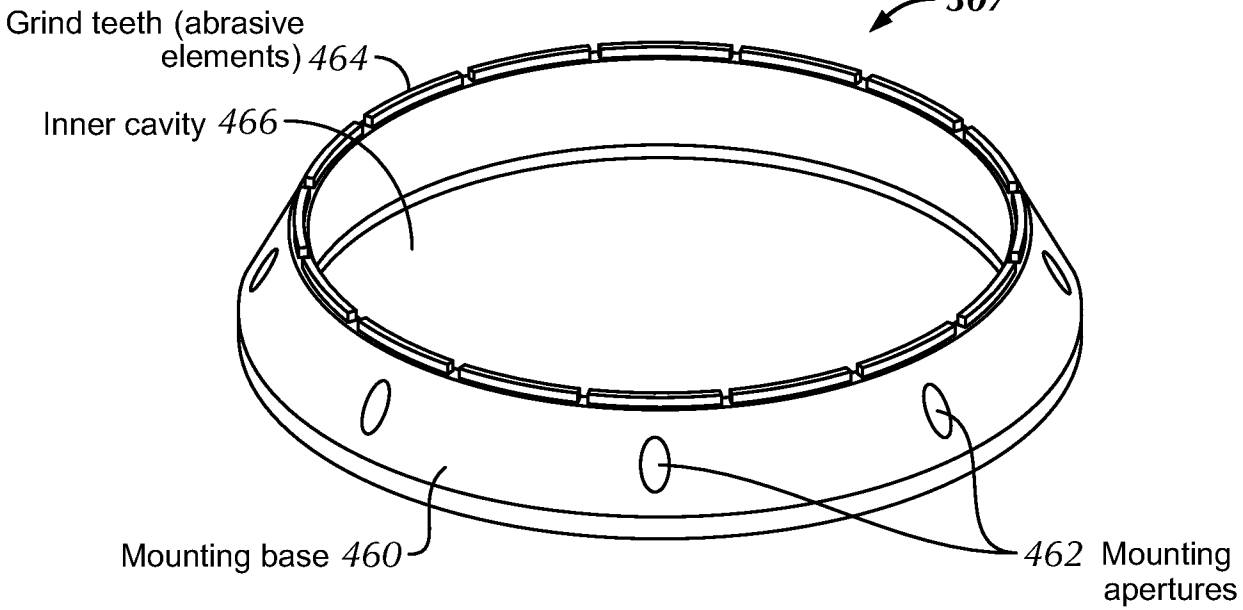
FIG. 4C shows a perspective view of a grind wheel in accordance with some embodiments.

FIG. 4C shows a perspective view of a grind wheel 307, in accordance with some embodiments, that can be incorporated into one or more of the grind engines 300, 330, 400, 430. The grind wheel 307 includes a mounting base 460, mounting apertures 462 and grind teeth or other relevant abrasive elements or structures 464. The plurality of mounting apertures 462 extend through a portion of the mounting base allowing bolts or the like to be inserted to secure the grind wheel 307 with the grind spindle 308. As described above and further below, the grind engine 300, 330, 400, 430 can include multiple grind wheels 307. For example, in some embodiments, two or more grind wheels 307 can be positioned in a nesting configuration with an outer grind wheel and a second inner grind wheel positioned within the inner cavity 466 of the outer grind wheel.

Referring to FIGS. 3A-B and 4A-B, the one or more alignment adjustment systems 311 provide alignment between the grind surface of the grind wheels 307 and the surface of the wafer (or other work product being ground or polished). The upper grind spindle 308 is mounted to one or more alignment adjustment systems 311 (e.g., three alignment adjustment systems located at 120 degrees from one another). These alignment adjustment systems 311 provide for the ability to position the grind spindle relative to the wafer and/or chuck. As introduced above, the grind spindle alignment can be a primary contributor to the surface profile ground into the wafer. The alignment adjustment system 311 provides the ability to achieve a precise alignment of the spindle, which is often critical, such as to achieve submicron wafer flatness. The alignment can be achieved, in some embodiments, consistent with the alignment adjustments described in U.S. Provisional Application No. 61/708,146, filed Oct. 1, 2012, entitled METHODS AND SYSTEMS FOR USE IN GRIND SHAPE CONTROL ADAPTATION, which is incorporated herein by reference in its entirety.

In some embodiments, the alignment adjustment system 311 can be manually set (e.g., via a wrench, screw driver, etc.). Some embodiments additionally or alternatively utilize a motor cooperated with a control system to provide partial or fully automated adjustments. For example, in some implementations, the alignment adjustment system includes a dual-threaded device cooperated with a motor providing a differential screw mechanism. The combination of two nested threads can at least in part provide for very fine pitch, or movement per revolution. In other embodiments, the adjustment method is automated and controlled by feedback and a controller (e.g., feedback through one or more sensors, probes, motors and the like to a controller and/or computer). Further, a grinding engine (e.g., grinding engine 300, 330, 400, 430) can include one or more manually operated alignment adjustment systems and one or more automated, motor controlled alignment adjustment systems.

Some embodiments fix a relative position of the work spindle 306 that rotates the chuck holding the wafer, and make three-dimensional adjustments to the angle of the grind spindle 308. Other embodiments may fix the grind wheel spindle 308 while making adjustments to the work chuck spindle 306. Yet other embodiments can implement adjustments to one or both the grind spindle 308 and the lower work spindle 306 as needed. The alignment adjustment systems 311, which can be cooperated with the grind spindle 308 and/or the work spindle 306 allows adjustments to establish and change relative alignment between the grind spindle 308 and the work spindle 306 and/or between the grind surface of the grind wheel 307 and the surface of the wafer.

As described above, the grind spindle alignments can be implemented manually by turning adjustment screws that affect spindle pitch and roll. A manual alignment set-up procedure is typically a multi-step procedure. First, instrumentation (e.g., one or more probes and/or dial indicators) is installed onto the grinding engine (e.g., grind engine 430) to measure relative alignment of the upper grind spindle 308 to the lower work spindle 306. Manual adjustments are then made to the alignment adjustment system and/or screws 311. For example, a probe is mechanically affixed to the grind spindle rotating axis; an optically flat fringe plate may be affixed to the work chuck spindle axis; the fringe plate is adjusted (e.g., to 1 micron TIR (total indicator runout)); the probe is swept across the fringe plate; and the grind pitch and/or roll can be adjusted relative to misalignment between grind spindle and work spindle axes. The instrumentation typically must be removed. In some instances, the grind wheel can then be used to grind the chuck, which "trues" the chuck such that runout is removed.

Next, test wafers are ground. The surface and/or shape profile of the wafer may then be evaluated to provide for additional and/or final data used to tune spindle alignment. Further adjustments may have to be made based on the evaluation of the wafer(s). In some instances, the instrumentation may have to be re-installed while implementing adjustments. Further wafer grind and evaluation may be performed to prove the alignment is set properly to provide the desired results. This "trial and error" process takes a long time (e.g., multiple hours) and typically needs an experienced technician and/or process engineer to evaluate post-grind test wafer surface profile and make intelligent decisions about which adjustment screws to turn, and how much to turn them to achieve the desired wafer surface profile.

Additionally, for some applications, the wafer (e.g., semiconductor wafer) is ground so thin that it is very difficult, and often impractical, to handle the post-ground wafer without damage. To allow for handling, some implementations employ a stacking technique, where the wafer to be ground is "stacked" onto a second carrier wafer. Grinding stacked wafers can be implemented, for example, for manufacture of Back-Side Illumination (BSI) and Through-Silicon Vias (TSV) type wafers. The carrier substrates used to fix the wafers during grinding, however, may have different shapes, surface profiles and thicknesses. These varying shapes and/or profiles can further contribute to variations and/or undesirable post-grind surface profile, Total Thickness Variations (TTV), Total Target Shape Variations (TTSV) of the wafer being ground and/or other such issues. In many instances, manually adjusting spindle alignment for optimal grinding of each distinct ground wafer based upon corresponding carrier wafer surface profile can be impractical, such as, for some high production fabrication processes and/or facilities.

As introduced above, U.S. Provisional Application No. 61/549,787, which is incorporated herein by reference, describes methods and systems to determine desirable and/or optimal alignment of the grind spindle 308 to the work chuck 305 and wafer. In some of these methods, sensors and/or probes collect data from the grinding engine 430 and/or the wafers, and a computer uses arithmetic calculations (e.g., reverse transformations and Euler angles) to define the optimal spindle alignment. These alignments can then be implemented through the alignment adjustment systems 311. Other methods and systems, however, can be used to determine adjustments to be made. The alignment adjustment systems 311 can be used manually or with automation. For example, some embodiments include one or more apparatuses or systems that mechanically and electrically enable the alignment of the grind spindle 308 based upon instructions from a computer or controller and/or one or more sensors. Further, some embodiments may include a powered spindle alignment apparatus that can be operated using electrical connections to a motor and controlled based upon inputs from an operator, sensors, probes, feedback control and/or computer.

Figure 5:
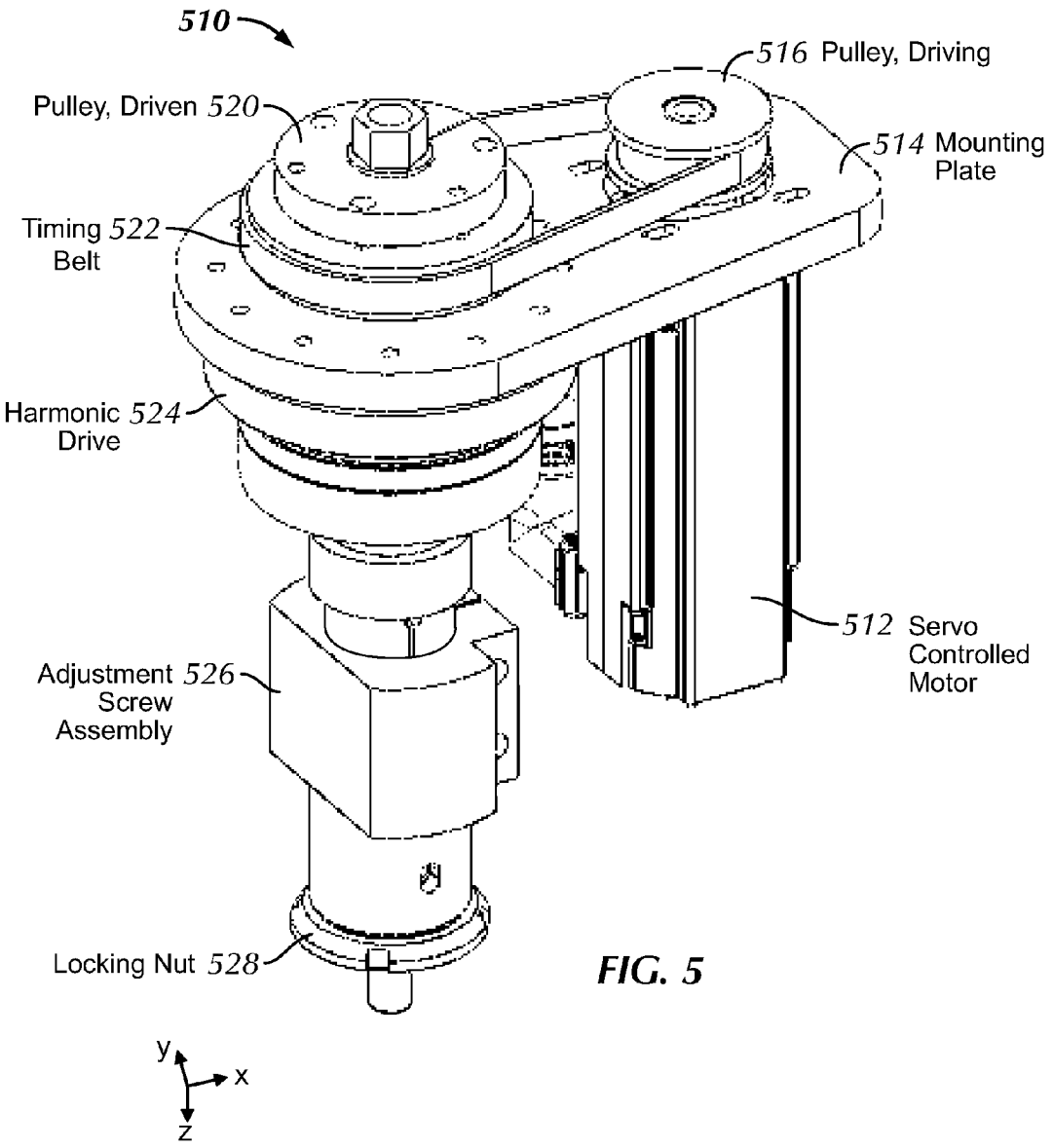
FIG. 5 shows a perspective view of an alignment adjustment apparatus or system, according to some embodiments.

FIG. 5 shows a perspective view of one example of an alignment adjustment apparatus or system 510, according to some embodiments, that can for example be incorporated into the grinding engine 300, 330, 400, 430 of FIGS. 3A-B and FIGS. 4A-4B, or other grind engines or systems. The alignment adjustment system 510 includes a motor 512, a mounting plate 514, a pulley and belt system including a driving pulley 516, a driven pulley 520 and a timing belt 522, a harmonic drive or reducer 524, an adjustment screw assembly 526, a locking nut 528 and other components. The motor 512 can be substantially any type of motor that can be controlled to accurately rotate the driving pulley 516. For example, the motor can be a servo-controlled motor, a stepper motor or other relevant motor. Further, the motor 512 can be coupled with a controller or computer to control the motor and the rotation of the driving pulley 516.

The motor 512 is cooperated with the pulley and timing belt system including the driving pulley 516 and timing belt 522. The timing belt 522 is cooperated with the second driven pulley which is axially attached to an input side of the harmonic drive 524. The motor 512 and harmonic drive 524 are cooperatively secured to the mounting plate 514. The mounting plate, in some embodiments, allows tension of the timing belt 522 to be adjusted (e.g., the motor and/or driving pulley 516, and/or the harmonic drive may be secured with the mounting plate through elongated mounting slots formed in the mounting plate allowing horizontal (or lateral) movement (in the "X" and/or "Y" directions as indicated in FIG. 5) to provide the increase or decrease in tension. In some embodiments, other types of reduction systems are utilized in place of or in addition to the harmonic drive 524. The harmonic drive 524 is utilized in some embodiments because it typically is compact, does not back drive and has little or no back lash and significant reduction ratio.

The output of the harmonic drive is connected to the adjustment screw assembly 526 (e.g., connected to a shaft of the adjustment screw assembly). The adjustment screw assembly 526 is a system or assembly that allows for precise adjustments up and down (i.e., in the "Z" direction as indicated in FIG. 5). The adjustment screw assembly 526 is mechanically cooperated or attached to a grind spindle mounting plate 332 cooperated with the grind spindle 308 in a way that allows the angle of the grind spindle 308 to be adjusted relative to the grinding machine base. Thus, the rotation of the motor 512 rotates the pulley, belt and harmonic drive system, which rotates at least a portion of the adjustment screw assembly 526, which then adjusts the grind spindle alignment angle.

In some embodiments, the adjustment screw assembly 526 employs a dual-thread system that provides precision alignment. Other types of adjustment screw assemblies can use a precision lead screw device, which may be an "off the shelf" lead screw device or a specifically configured lead screw device. Additionally or alternatively, some embodiments can include "kinematic mounting connections" between the adjustment screw assemblies 526 and the upper bridge casting 303 and/or the grind spindle mounting plate 332. For example, kinematic couplers can be utilized that kinetically constrain the adjustment assembly (or other part cooperated), which can provide constraints in all six degrees of freedom.

Figure 6:
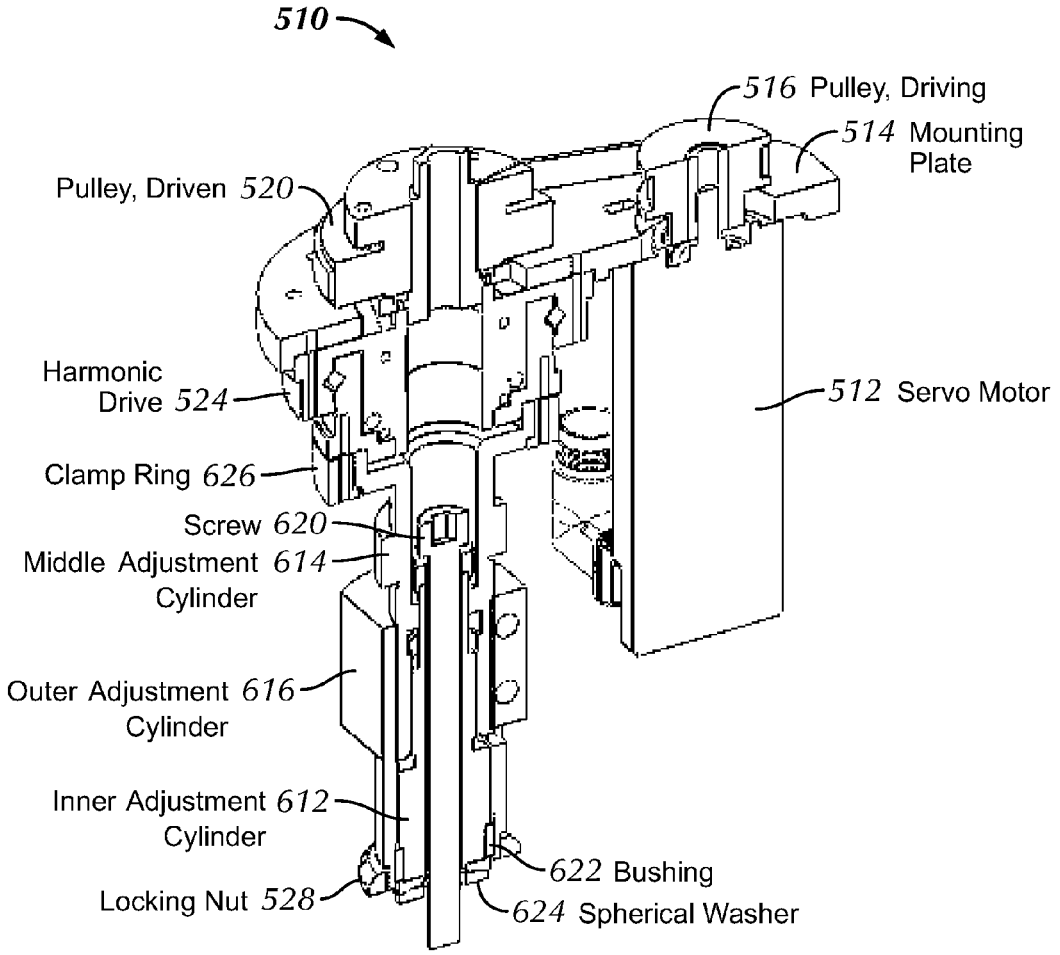
FIG. 6 shows a cross-sectional view of the alignment adjustment system of FIG. 5, according to some embodiments.

FIG. 6 shows a cross-sectional view of the alignment adjustment system 510 of FIG. 5 showing at least some of the components of an adjustment screw assembly 526, according to some embodiments. The adjustment screw assembly 526 can include an inner adjustment sleeve 612, cylinder or other relevant structure, a middle adjustment sleeve 614, cylinder or other relevant structure, and an outer adjustment sleeve 616, cylinder or other relevant structure. Some embodiments further include a bolt or screw 620, one or more bushings or bearings 622, one or more washers 624 (e.g., a spherical washer), a clamp ring 626, a dowel pin (724, see FIG. 7), and other such components.

The inner adjustment sleeve 612 can be cooperated with the upper bridge casting 303. The middle adjustment sleeve 614 can be connected to the harmonic drive 524 that can rotate the middle adjustment sleeve. The outer adjustment sleeve 616 connects with the grind spindle mounting plate 332, for example, through the locking nut 528. In some embodiments, the locking nut 528 threads onto the outer adjustment sleeve 616. The tightening of the locking nut 528 can secure the outer adjustment sleeve 616 to the grind spindle mounting plate 332.

Figure 7:
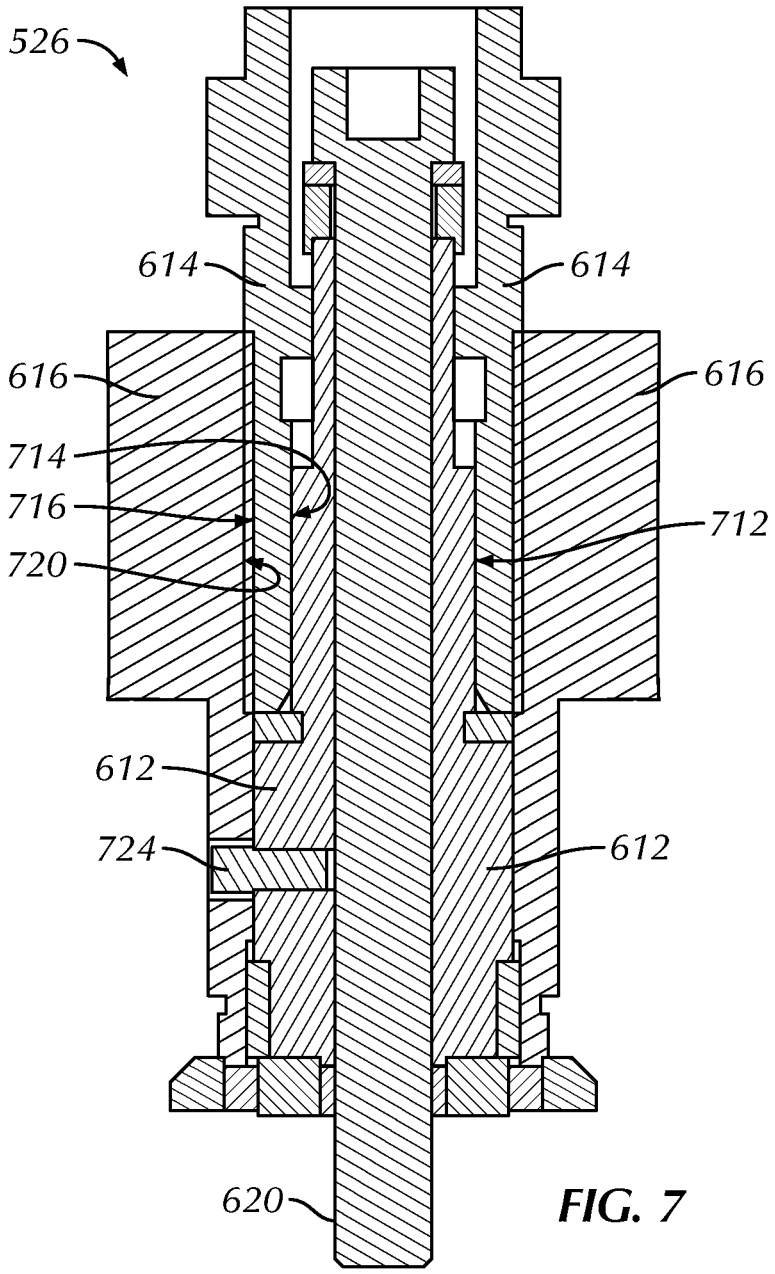
FIG. 7 shows a simplified cross-sectional view of a portion of an adjustment screw assembly of an alignment adjustment system, according to some embodiments.

FIG. 7 shows a simplified cross-sectional view of a portion of an adjustment screw assembly 526, according to some embodiments. The inner adjustment sleeve 612 has an outer surface 712, where some or all of the outer surface 712 is threaded. The middle adjustment sleeve 614 has an inner surface 714 and an outer surface 716, where some or all of the inner surface 714 and the outer surface 716 are threaded. The outer adjustment sleeve 616 has an inner surface 720 that is at least partially threaded. The threading of the inner surface 714 of the middle adjustment sleeve 614 cooperates with the threading of the outer surface 712 of the inner adjustment sleeve 612. Similarly, the threading of the outer surface 716 of the middle adjustment sleeve 614 cooperates with the threading of the inner surface 720 of the outer adjustment sleeve 616.

Figure 8:
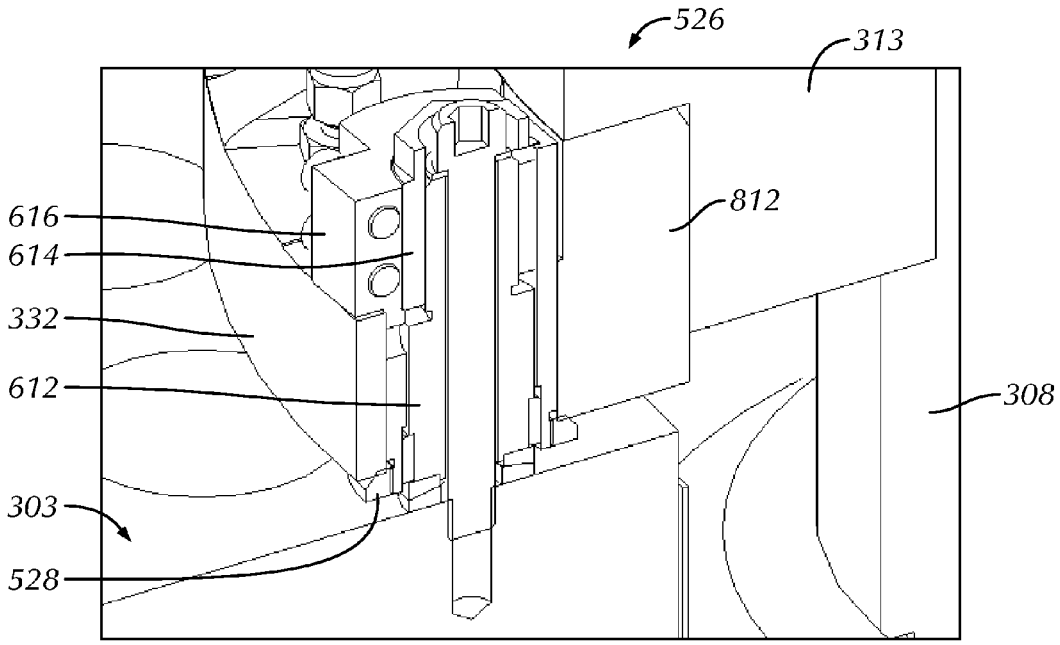
FIG. 8 shows a simplified cross-sectional view of a portion of an adjustment screw assembly, according to some embodiments.

FIG. 8 shows a simplified cross-sectional view of a portion of an adjustment screw assembly 526 according to some embodiments. The adjustment screw assembly 526 is also depicted in cooperation with the grind spindle 308 through a grind spindle mounting plate 332 and the upper bridge casting 303. It is noted that FIG. 8 does not show the motor 512, pulley, belt and harmonic drive system, and accordingly is similar to some embodiments of a manually operated alignment adjustment system 311. As shown in FIG. 8, the outer adjustment sleeve 616 is connected to the grind spindle mounting or adjustment plate 332 (e.g., through the locking nut 528), and the inner adjustment sleeve 612 is connected to the upper bridge casting 303. As described above, the middle adjustment sleeve 614 is connected to the output of the harmonic drive 524. Some implementations include a dowel pin 724 that is incorporated into the adjustment screw assembly 526. The dowel pin 724 can lock (orient) the inner adjustment sleeve 612 with the outer adjustment sleeve 616. The middle adjustment sleeve 614 is clamped to an output shaft and/or flange of the harmonic drive 524 via the clamping ring 626.

Figure 9:
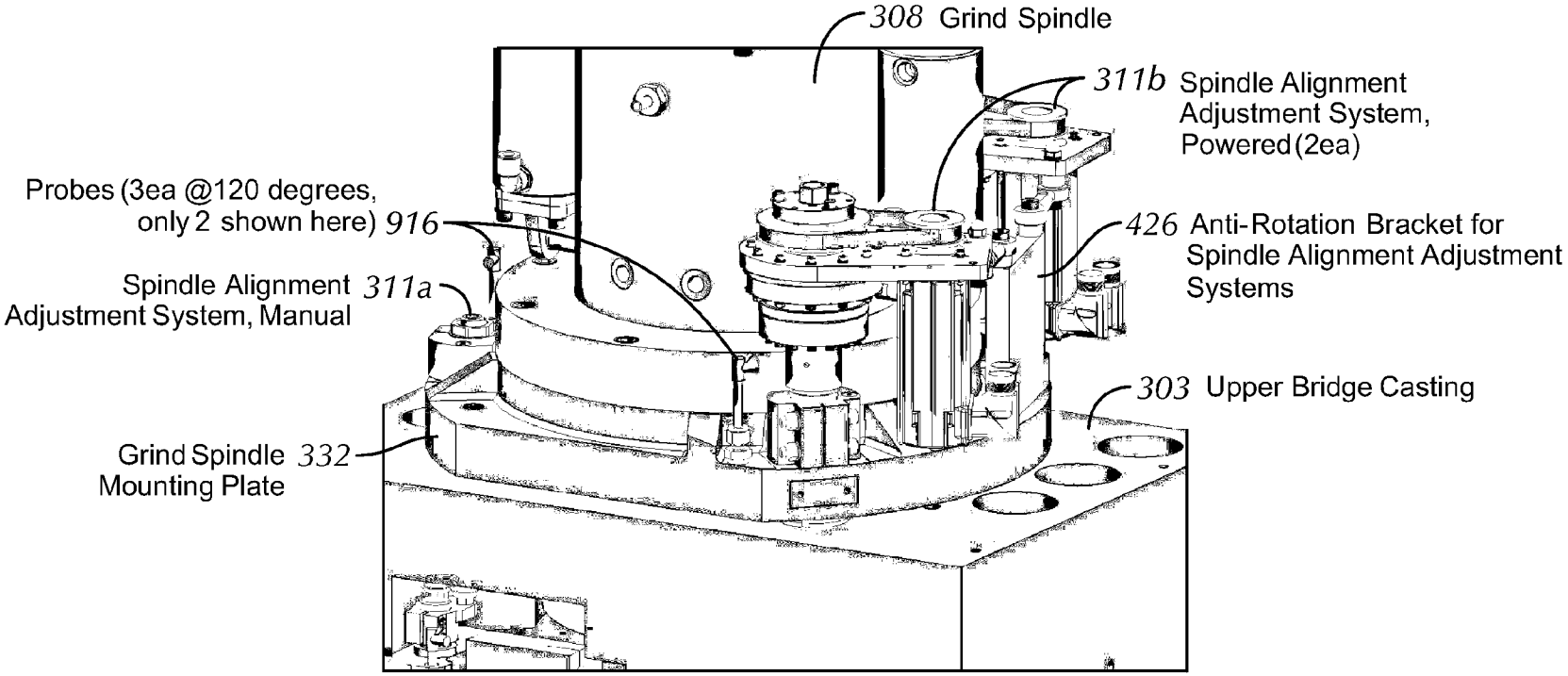
FIG. 9 depicts a perspective view of a portion of a grind engine, in accordance with some embodiments.

FIG. 9 depicts a perspective view of a portion of a grinding engine 330 including a manually operated spindle alignment adjustment system 311*a* and two powered or automated spindle alignment adjustment systems 311*b*, in accordance with some embodiments. The powered alignment adjustment systems 311*b* are similar to the alignment adjustment system depicted in at least FIGS. 5 and 6. The alignment adjustment systems 311*a-b* are secured with the grind spindle mounting plate 332 to provide the alignment adjustments. Further, one or more probes 916 can be included, such as one or more probes 916 positioned relative to and in close proximity to each alignment adjustment system 311. Some embodiments additionally include an anti-rotation bracket 426 cooperated with one or more the alignment adjustment systems 311*a-b*.

Figure 10:
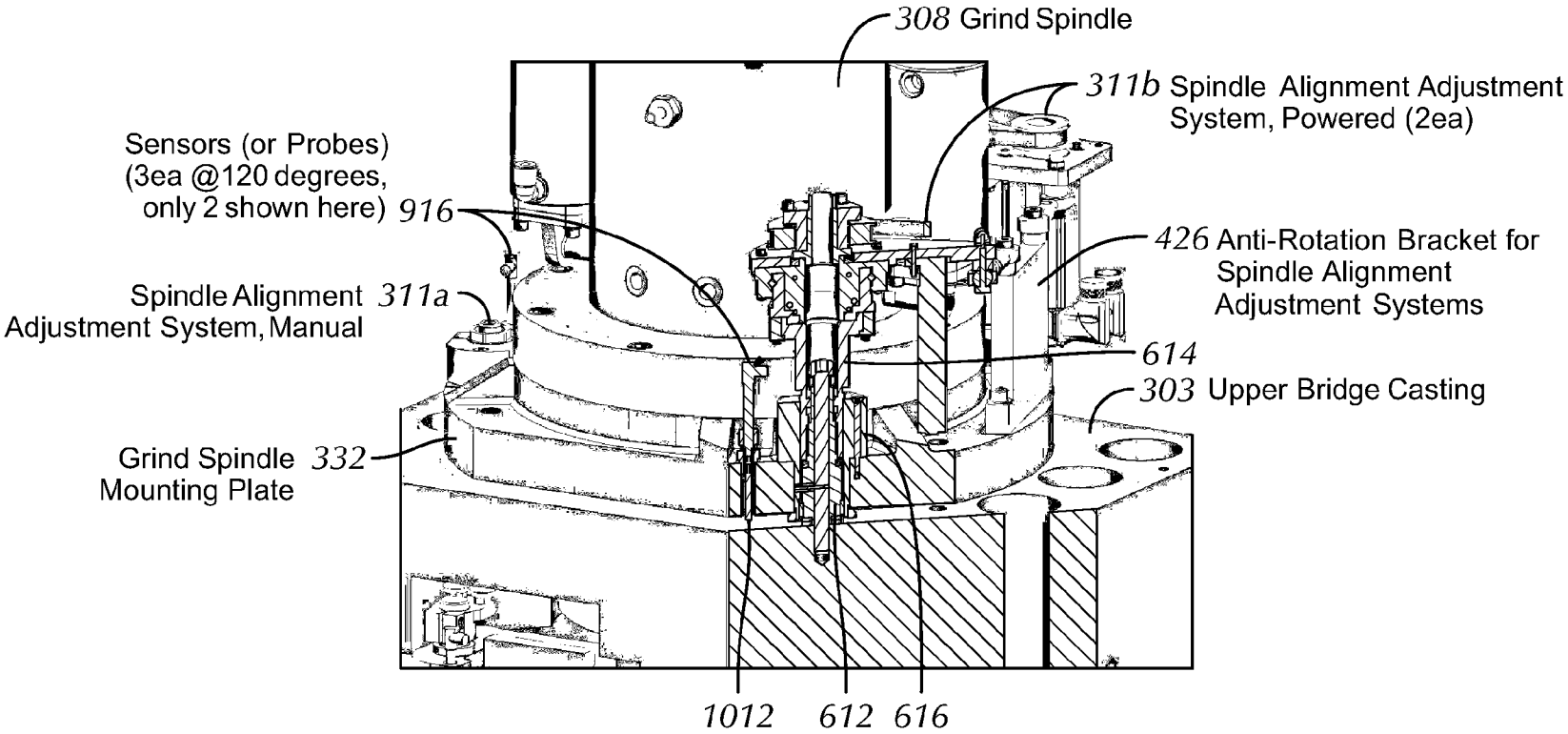
FIG. 10 depicts the perspective view of the grind engine of FIG. 9, while showing a cross-sectional view of a powered alignment adjustment system and a probe.
Figure 11:
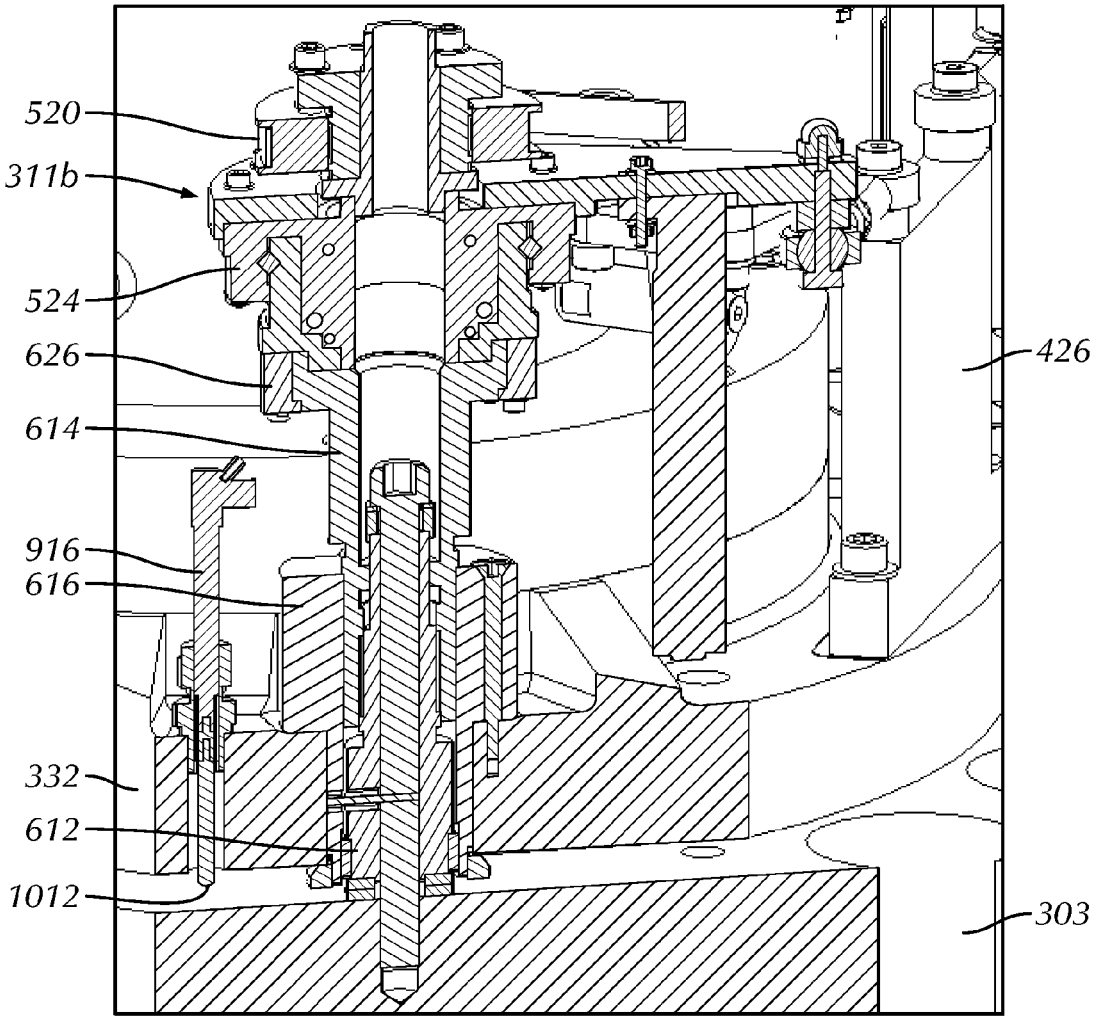
FIG. 11 shows a magnified, cross-sectional view of the powered alignment adjustment system and probe of FIG. 10.

FIG. 10 depicts the perspective view of the grinding engine 330 of FIG. 9, while also showing a cross-sectional view of a powered alignment adjustment system 311*b* cooperated with the grind spindle mounting plate 332, and further shows a cross-sectional view of a probe 916 proximate the alignment adjustment system. FIG. 11 shows a magnified, cross-sectional view of the powered alignment adjustment system 311*b* and probe 916 of FIG. 10. Referring to FIGS. 9-11, the probe 916 can be affixed with the grind spindle mounting plate 332 and can extend to touch and/or reference the upper bridge casting 303. In some implementations, the one or more probes 916 (for example, there could be three probes positioned approximately 120 degrees from each other) can be mounted to the grind spindle mounting plate 332 with the tips 1012 of the probes 916 referencing the upper bridge casting 303. The probe 916 can be configured to detect and/or measure an amount of movement of the grind spindle 308 and/or a change in distance between the grind spindle mounting plate 332 and the upper bridge casting 303. The detected distance changes are then mathematically correlated to a change in position of the grind spindle axis, which can be used to calculate resulting changes that would occur to the wafer surface profile from grinding.

Referring to FIGS. 5-11, the one or more alignment adjustment systems 311 are attached to the grind spindle assembly. The inner adjustment sleeve 612 is attached to the upper bridge casting 303, which in some embodiments is a solid, stable iron casting The outer adjustment sleeve 616 is attached to the grind spindle mounting plate 332, which is attached to a z-axis air bearing sleeve 313, grind spindle housing or other structure. Therefore, movement of the grind spindle mounting plate 332 induces movement in the spindle housing and thus the grind spindle 308. In some implementations, the inner adjustment sleeve 612 is bolted to the upper bridge casting 303 via the bolt 620 and through the spherical washer 624, which allows the sleeve to change its angular relationship with the base. The outer adjustment sleeve 616 is rigidly connected to the grind spindle mounting plate 332 by the locking nut 528. The air bearing sleeve 313 is bolted to the grind spindle mounting plate 332.

The inner adjustment sleeve 612 and outer adjustment sleeve 616 are rotationally "locked" together via the dowel pin 724. That is, when the middle adjustment sleeve 614 is rotated (e.g., by the harmonic drive 524, manually or other method) it causes the inner adjustment sleeve 612 to travel in one direction (e.g., up (in the z-direction)), while the outer adjustment sleeve 616 travels in the opposite direction (e.g., down). In some embodiments, the thread pitch between the inner adjustment sleeve 612 and the middle adjustment sleeve 614, and the thread pitch between the outer adjustment sleeve 616 and the middle adjustment sleeve 614 are established to be similar to one another, but not the same. In this way, the effective pitch of both threads can result in an extremely fine pitch resolution. For example, in some embodiments, the outer adjustment sleeve thread can be approximately 1-½ inch–12 (0.0833 inch pitch), while the inner adjustment sleeve thread is about 1 inch–14 (0.0714 inch pitch). This combination results in an effective thread pitch of the adjustment screw assembly 526 of approximately:

$$0.0833\ \text{inch} - 0.0714\ \text{inch} = 0.0119\ \text{inch pitch.}$$

With this pitch ratio, turning the middle adjustment sleeve 614 one rotation induces a travel along the z-axis (e.g., up) of about 0.0119 inches of the outer adjustment sleeve 616 (assuming the inner adjustment sleeve 612 is fixed), or about 0.000033 inches of travel per degree of rotation of the middle adjustment sleeve 614. Other rotation reduction ratios can be achieved depending on the design of the belt/pulley system 516, 520, 522, along with the harmonic drive 524, and the pitches of the threading of the adjustment screw assembly 526 where some embodiments are configured to create very significant amounts of rotational reduction. The combination of belt and gear reduction, along with the design of the adjustment screw assembly 526 allows for extreme up and/or down movement precision and resolution through the motor 512. For example, in some embodiments, the harmonic drive 524 has a reduction of about 160:1, while the belt/pulley has a reduction of 2:1. Thus, total reduction between the motor 512 and the output of the harmonic drive is about 320:1. As such, 1 degree of rotation of the motor output will induce about 0.003125 degrees of rotation at output of the harmonic drive 524, and cause the adjustment screw assembly 526 to induce a travel of about 0.00000012 inches, providing approximately 0.000037 inches of travel along the z-axis for one complete rotation of the motor 512.

In some instances, the high leverage of these small precision movements apply relatively high force levels that may distort and/or bend the adjustment screw assembly 526 within the elastic limits of the materials that align the grind spindle 308. Some embodiments may alternatively or additionally use kinematic coupling devices to connect the adjustment screw assemblies 526 to the upper bridge casting 303, which may eliminate the bending and/or distortion of the devices. The kinematic coupling devices may also reduce overall stiffness of the grind spindle mounting plate 332, which in some instances may be undesirable because the grind spindle 308 may move away from a desired alignment while under the influence of forces generated during grinding.

Typically, the grinding engine (e.g., grind engine 430) includes multiple alignment adjustment systems 311. For example, some embodiments include three alignment adjustment systems 311 spaced about 120 degrees from one another, which are mounted between the grind spindle 308 and a solid upper bridge casting 303 to enable the movement within the alignment adjustment system 311 to align the grind spindle 308. Often, the alignment can be achieved through the adjustment of less than all of the alignment adjustment systems 311 (e.g., one or two of the three alignment adjustment systems). For example, with powered alignment adjustment systems, two of the three alignment adjustment systems 311 may be powered using the motor apparatus described above.

In some embodiments, the mounting plate 514 provides additional functionality and/or benefits beyond mounting and positioning the motor 512, pulley/belt system, and harmonic drive, and allowing for belt tension and motor mounting. Again, the pulley/belt system can provide a reduction in turn ratio. Further, with precision semiconductor wafer grinding, changes in grind spindle alignment of just a few fractions of a degree can cause significant changes in the grinding results on the wafer surface profile. Some embodiments can be configured with the motor 512 directly connect to the harmonic drive or the motor may be connected with the harmonic drive through another type of drive reduction.

In some instances, with the motor 512 directly connected to the harmonic drive, heat generated by the motor can transfer through the harmonic drive to the adjustment screw assembly 526, causing it to expand, and potentially causing undesirable changes to grind spindle alignment. Additionally, the motor 512 could be generating heat even as it sits "idle" due, for example, to factors such as holding torque and how the motor is tuned. Therefore, although other common drive configurations and methods could be used to couple the motor 512 to the adjustment screw assembly 526, the belt/pulley system 516, 520, 522 keeps the heat from the motor 512 separated from the adjustment screw assembly 526.

The material chosen for the mounting plate 514 can be substantially any relevant material that can support the components and maintain the desired tension in the timing belt 522. In some instances, the material to construct the mounting plate 514 has poor heat conducting characteristics. For example, a Phenolic, which does not conduct heat well, could be used. Other "poor" heat conducting materials could alternatively or additionally be used to make the mounting plate, although Phenolic is generally inexpensive, resists creeping, and is mechanically rigid enough with a sufficient thickness to provide a secure base for the motor/belt system. Other fabric or fiber reinforced composites and plastics could also be used to construct some or all of the mounting plate 514, while some metals could also be used, but may be less desirable due to potential heat transfer. Other components or additional components may be added to provide some insulation between the mounting plate 514 and the adjustment screw assembly 526 (e.g., plastic or other guards, washers or the like). Similarly, various materials can be used in constructing the inner, middle and outer adjustment sleeves, the dowel pin, the locking nut, the washer, and other parts of the adjustment screw assembly 526, such as but not limited to cast iron, steel, stainless steel, and the like. For example, in some embodiments the middle adjustment sleeve 614 can be formed from hardened steel, the inner and outer adjustment sleeves 612, 616 can be formed from nickel plated cast iron, the locking nut 528 can be formed from an alloy steel, and fasteners can be formed from steel or stainless steel.

Other embodiments provide alternate or additional alignment adjustment systems. For example, some embodiments may include piezoelectric devices used to move the grind spindle 308, although relatively high electrical voltage may be needed with these embodiments.

Figure 12:
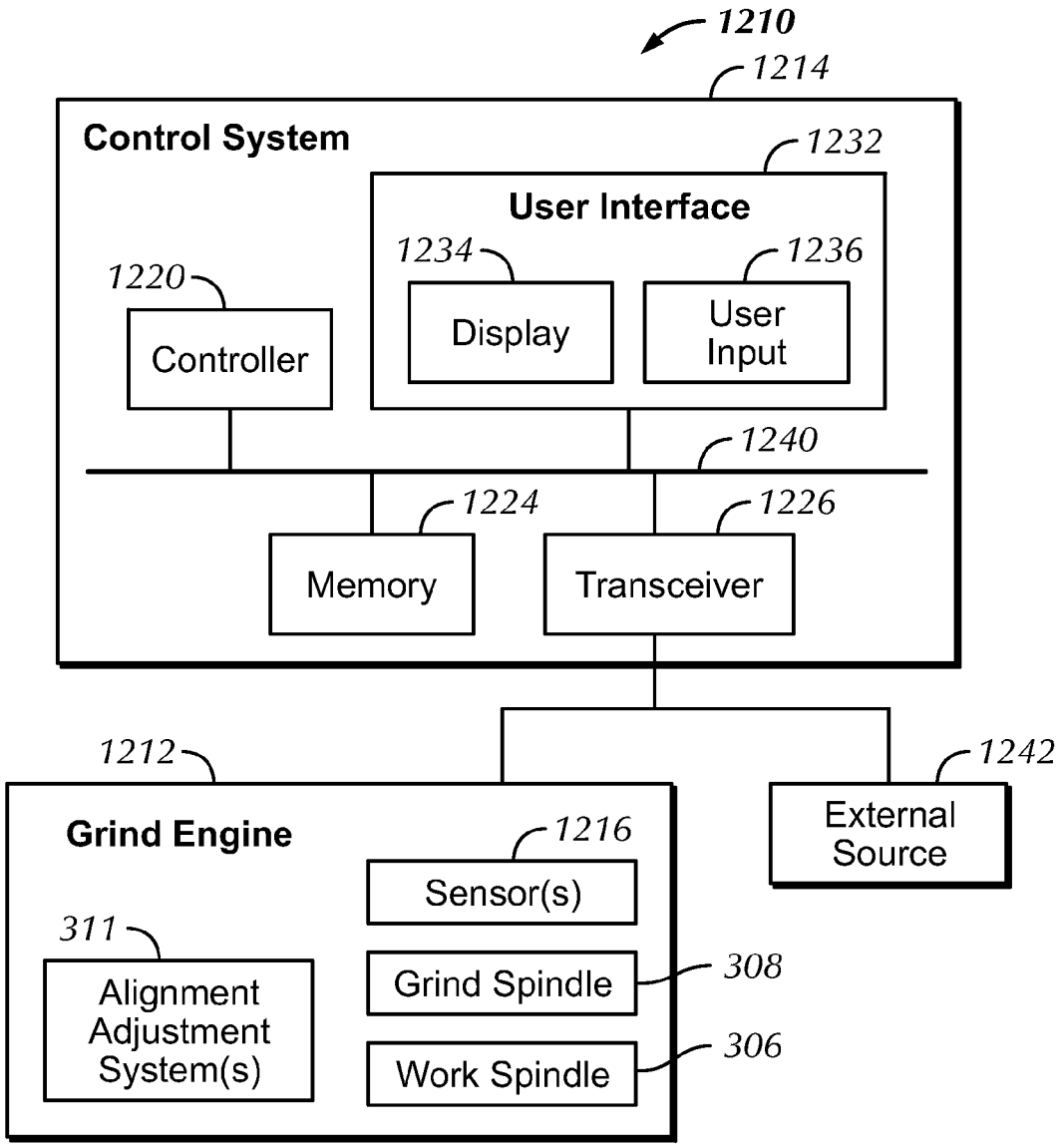
FIG. 12 depicts a simplified block diagram of a grind system, according to some embodiments.

FIG. 12 depicts a simplified block diagram of a grind system 1210, according to some embodiments, that can be used to grind and/or polish wafers or other relevant work objects. The grind system 1210 includes a grind engine 1212 and a controller or control system 1214. The grind engine 1212 can, in some embodiments, be similar to the grinding engine 300, 330, 400, 430 of FIGS. 3-4, and can include the grind spindle 308, the work spindle 306, the alignment adjustment systems 311, one or more sensors or probes 1216 and other components including those described above with respect to at least the grinding engines 300, 330, 400, 430 of FIGS. 3-4.

The control system 1214 couples with the sensors and/or probes 1216 to receive measured or sensor data, such as but not limited to distance information, occurrences of contact, orientation, angles, speed of rotation, distance or amount of rotation of the motors 512, and/or other such relevant information. For example, the sensors 1216 can include sensors described in U.S. Provisional Application No. 61/549,787. The control system 1214 further can couple with the motors 512 of the alignment adjustment systems 311. Utilizing the sensor information and/or other information (e.g., wafer surface measurements and the like, desired surface results, etc.) the control system 1214 can determine alignment adjustments to be made. Once determined the control system 1214 can activate one or more of the alignment adjustment systems 311 to implement the desired alignment. The sensors 1216 can continue to provide information as feedback to the control system 1214 allowing the control system to continue to implement adjustments to achieve the desired alignment. Accordingly, the alignment can be achieved through one or more fully or partially automated processes. Further, the automated process can prevent many if not all of the steps performed when doing a manual alignment as described above.

The control system 1214 can be incorporated as part of the grind engine 1212 or separate from the grind engine. Further, the control system can be implemented through one or more devices or systems that can be implemented through hardware, software or a combination of hardware and software. By way of example, the control system 1214 may additionally comprise a controller or processor module 1220, memory 1224, a transceiver 1226, a user interface 1232, and one or more communication links, paths, buses or the like 1240. A power source or supply (not shown) is included or coupled with the control system 1214.

The controller 1220 can be implemented through one or more processors, microprocessors, computers, controllers, central processing unit, logic, local digital storage, firmware and/or other control hardware and/or software, and may be used to execute or assist in executing the steps of the methods and techniques described herein, and control various communications, programs, content, listings, services, interfaces, etc. The memory 1224, which can be accessed by the controller 1220, typically includes one or more processor readable and/or computer readable media accessed by at least the controller 1220, and can include volatile and/or nonvolatile media, such as RAM, ROM, EEPROM, flash memory and/or other memory technology. Further, the memory 1224 is shown as internal to the control system 1214; however, the memory 1224 can be internal, external or a combination of internal and external memory. The external memory can be substantially any relevant memory such as, but not limited to, one or more of flash memory secure digital (SD) card, universal serial bus (USB) stick or drive, other memory cards, hard drive and other such memory or combinations of such memory. The memory 1224 can store code, software, executables, scripts, data, graphics, parameter information, alignment information, wafer characteristics, wafer surface profiles and/or shapes, textual content, identifiers, log or history data, user information and the like.

In some embodiments, the grind system 1210 and/or the control system 1214 can include a user interface 1232. The user interface can allow a user to interact with the grind system 1210 and/or the control system 1214, provide information to the grind system 1210 and/or receive information through the grind system 1210. In some instances, the user interface 1232 includes a display 1234 and/or one or more user inputs 1236, such as keyboard, mouse, track ball, touch pad, buttons, touch screen, a remote control, etc., which can be part of or wired or wirelessly coupled with the grind system 1210 or control system 1214.

Typically, the control system 1214 further includes one or more communication interfaces, ports, transceivers 1226 and the like allowing the control system 1214 to communicate with the alignment adjustment systems 311, the sensors and/or probes 1216, the grind spindle or grind spindle motor(s), the work spindle or work spindle motor(s), and/or other devices or sub-systems of the grind system 1210. Additionally, in some embodiments, the transceiver 1226 may provide communication over the communication link 1240, a distributed network, a local network, the Internet, and/or other networks or communication channels to communicate with other devices, systems or sources 1242, and/or provide other such communications. Further the transceiver 1226 can be configured for wired, wireless, optical, fiber optical cable or other such communication configurations or combinations of such communications.

The one or more sensors and/or probes 1216 are shown as internal to the grinding engine 300; however, the one or more sensors and/or probes 1216 can be internal, external or a combination of internal and external sensors. The one or more sensors 1216 and sensor information provided from the one or more sensors can be used to determine alignment of the grind spindle 308, wafer or work spindle 306, wafer surface, grind surface of the wheels 307 and/or other relevant alignment; rotational speed, pressure, distance, height, temperature, thickness, wafer profile, wafer characteristics, or substantially any other relevant parameter that can be sensed, or combinations of such sensors.

Figure 13:
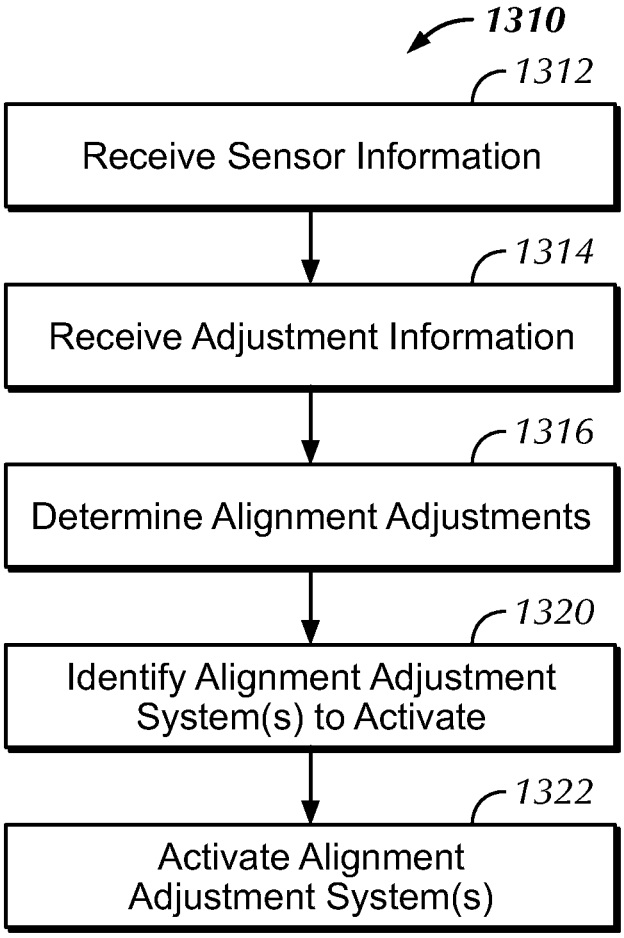
FIG. 13 shows a simplified flow diagram of a process, according to some embodiments, of implementing adjustments to alignment between the grind spindle and the work spindle.

FIG. 13 shows a simplified flow diagram of a process 1310, according to some embodiments, of implementing adjustments to alignment between the grind spindle 308 and the work spindle 306 providing the desired alignment between the grind wheel surface and the surface of the wafer (or other work product being ground or polished) to achieve the desired resulting surface profile of the wafer. In optional step 1312, the control system 1214 receives sensor and/or probe information regarding at least the relative positioning of the grind spindle 308 and the work spindle 306. Some embodiments additionally or alternatively include optional step 1314, where the control system receives adjustment information from another source 1242. For example, a wafer evaluation system that evaluates the surface profile and/or shape of a carrier wafer or a previously ground wafer may provide information about the carrier wafer and/or alignment adjustment information based on the surface profile and/or shape of a carrier wafer; information about an evaluation of a ground wafer in confirming alignment; or other such information or combinations of such information.

In step 1316, the alignment adjustments are determined to achieve the desired alignment. The determination of the alignment adjustments to implement can, in some embodiments, include some or all of the information determined and described in U.S. Provisional Application No. 61/549, 787. Other information can be used or determined based on other factors. Further, the alignment adjustments to implement can be determined based on the sensor information or other information, including information that might be provided by an external source 1242. Still further, step 1316 can be implemented by the control system 1214 using the relevant sensor information and/or other relevant information. In some embodiments, the alignment adjustments and/or part of the alignment adjustments to implement may be provided by an external source 1242. In step 1320, one or more of the alignment adjustment systems 311 are identified to be activated, and an amount of adjustment is determined for each identified alignment adjustment systems. For example, an angle of adjustment can be calculated, and based on the angle of adjustment the amount of rotation can be determined (e.g., number of rotations and/or amount of partial rotation) for each motor 512 of the one or more identified alignment adjustment systems. Again, for example, the alignment adjustment can be determined as described in U.S. Provisional Application No. 61/549,787, which is incorporated herein by reference in its entirety.

In step 1322, the one or more alignment adjustment systems 311 are activated to implement the determined adjustments. The process 1310 may be repeated one or more times depending on subsequent measurements, subsequent sensor information, confirmation steps, and/or other such information. For example, in some instances, a wafer may be ground and the ground wafer evaluated to determine whether further adjustments are to be implemented.

One or more of the embodiments, methods, processes, approaches, and/or techniques described above or below may be implemented, at least in part, through one or more computer programs executable by one or more processor-based systems. By way of example, such a processor based system may comprise a processor based control system 1214, a computer, a dedicated processing systems, tablet, etc. Such a computer program may be used for executing various steps and/or features of the above or below described methods, processes and/or techniques. That is, the computer program may be adapted to cause or configure a processor-based system to execute and achieve the functions described above or below. For example, such computer programs may be used for implementing any embodiment of the above or below described steps, processes or techniques for providing alignment, grinding and/or polishing. As another example, such computer programs may be used for implementing any type of tool or similar utility that uses any one or more of the above or below described embodiments, methods, processes, approaches, and/or techniques. In some embodiments, program code modules, loops, subroutines, etc., within the computer program may be used for executing various steps and/or features of the above or below described methods, processes and/or techniques. In some embodiments, the computer program may be stored or embodied on a non-transitory computer readable storage or recording medium or media, such as any of the computer readable storage or recording medium or media described herein.

Accordingly, some embodiments provide a processor or computer program product comprising a medium configured to embody a computer program for input to a processor or computer and a computer program embodied in the medium configured to cause the processor or computer to perform or execute steps comprising any one or more of the steps involved in any one or more of the embodiments, methods, processes, approaches, and/or techniques described herein. For example, some embodiments provide one or more computer-readable storage mediums storing one or more computer programs for use with a computer simulation, the one or more computer programs configured to cause a computer and/or processor based system to execute steps comprising: determining alignment adjustments relative to a grind spindle; and automatically implementing the adjustments.

Other embodiments provide one or more computer-readable storage mediums storing one or more computer programs configured for use with a computer simulation, the one or more computer programs configured to cause a computer and/or processor based system to execute steps comprising: receiving sensor and/or probe information regarding positioning the grind spindle relative to a work spindle; determining alignment adjustments to implement; identifying one or more of the alignment adjustment systems to be activated, and an amount of adjustment to implement for each identified alignment adjustment systems; and activating the one or more alignment adjustment systems.

Some embodiments provide at least a partially or fully automated process for implementing the alignment between the grind spindle 308 and the work spindle 306 achieving the desired alignment between the grind wheel surface and the surface of the wafer. Further, some embodiments provide motors cooperated with alignment adjustment systems to simplify the alignment, and in some instances enhance the precision of alignment. Additionally, some embodiments provide a reduction in rotational ratio between the motor and the adjustment alignment systems providing highly precision alignments Still further, some embodiments utilize feedback to achieve the desired alignment, such as through sensors or probes.

Control of the alignment can be partially or fully automated. Accordingly, some embodiments are provided with desired resulting wafer surface profiles, and the system can calculate alignment positioning and activate the alignment adjustment systems to provide the alignment between the work spindle and the grind spindle to achieve the alignment that can produce the resulting wafer with the desired surface profile. The precision alignment can allow substantially any relevant alignment and/or to compensate for variations, including with carrier wafers. Further still, the partially or fully automated alignment adjustments can allow for optimal grinding of each distinct wafer. Similarly, the partially or fully automated alignment adjustments can allow for optimal grinding of each distinct wafer based upon corresponding carrier wafer surface profile and/or shape with high production fabrication processes and/or facilities.

What is claimed is:

1. A grinding engine, comprising:

a work spindle;

a work chuck cooperated with the work spindle;

a grind spindle;

a grind wheel cooperated with the grind spindle; and a plurality of alignment adjustment systems positioned relative to and around the grind spindle, wherein adjustment from any one of the alignment adjustment systems is configured to cause a change in alignment between the work spindle and the grind spindle, wherein a first alignment adjustment system of the plurality of alignment adjustment systems comprises:

an inner adjustment sleeve;

an outer adjustment sleeve; and a middle adjustment sleeve mechanically cooperated with the inner adjustment sleeve and the outer adjustment sleeve such that a rotational change of the middle adjustment sleeve induces an axial movement of the outer adjustment sleeve relative to the inner adjustment sleeve.

2. The grind engine of claim 1, wherein the first alignment adjustment system comprises a motor cooperated with the middle adjustment sleeve, where activation of the motor is configured to cause rotation of the middle adjustment sleeve.

3. The grind engine of claim 1, wherein the first alignment adjustment system further comprises a reducer coupled between the motor and the middle adjustment sleeve, where activation of the motor activates the reducer that rotates the middle adjustment sleeve.

4. The grind engine of claim 1, wherein:

the inner adjustment sleeve comprises an outer surface wherein at least a portion of the outer surface of the inner adjustment sleeve is threaded;

wherein the outer adjustment sleeve comprises an inner surface wherein at least a portion of the inner surface of the outer adjustment sleeve is threaded;

wherein the middle adjustment sleeve comprises an inner surface and an outer surface, wherein at least a portion of the inner surface of the middle adjustment sleeve is threaded and the threaded portion of the inner surface of the middle adjustment sleeve cooperates with the threaded portion of the outer surface of the inner adjustment sleeve; and wherein the threaded portion of the outer surface of the middle adjustment sleeve cooperates with the threaded portion of the inner surface of the outer adjustment sleeve.

5. The grind engine of claim 1, further comprising:

a grind spindle mounting plate coupled with the outer adjustment sleeve and further cooperated with the grind spindle and induces movement of the grind spindle housing relative to the work spindle in response to movement between the inner adjustment sleeve and the outer adjustment sleeve; and an upper bridge casting coupled with the inner adjustment sleeve and further cooperated with the work spindle such that movement of the grind spindle housing relative to the work spindle induces an angular change between the grind spindle and the work spindle.

6. The grind engine of claim 1, wherein the plurality of alignment adjustment systems comprises at least three alignment adjustment systems spaced about the grind spindle.

7. The grind engine of claim 1, wherein the plurality of alignment adjustment systems are spaced equally around the grind spindle.

8. The grind engine of claim 1, further comprising:

a plurality of sensors positioned relative to and around the grind spindle;

a controller coupled with the plurality of sensors and configured to receive sensor information from the plurality of sensors regarding positioning of the grind spindle relative to the work spindle, and to control one or more of the plurality of alignment adjustment systems as a function of the sensor information to control adjustments through the one or more of the plurality of alignment adjustment systems to achieve a desired angular alignment between the work spindle and the grind spindle.

9. The grind engine of claim 1, wherein the plurality of sensors comprise one or more distance sensors each configured to sense a change in distance that the controller correlates to a change in position of a grind spindle axis to achieve a desired change in resulting wafer surface profile achieved through grinding.

10. The grind engine of claim 1, further comprising:

a controller coupled with each of the plurality of alignment adjustment systems and configured to obtain alignment adjustments to implement, identify one or more of the alignment adjustment systems to be activated, identify an amount of adjustment to implement for each identified alignment adjustment systems; and activate the one or more alignment adjustment systems identified to be activated to implement the corresponding identified amount of adjustment.

11. The system of claim 1, wherein the plurality of alignment adjustment systems are spaced from each other and distributed around the grind spindle, wherein the adjustment from at least one of the plurality alignment adjustment systems causes a change in angular alignment between the work spindle and the grind spindle.

12. A method, comprising:

determining angular alignment adjustments relative to a grind spindle comprising:

determining which of a plurality of alignment adjustment systems of a wafer grinding system, which are positioned relative to and spaced from each other around the grind spindle, to activate; and determining an amount of adjustment to implement by each of one or more of the alignment adjustment systems to be activated comprising: determining an angular adjustment to achieve;

calculating a change in distance to implement corresponding to the angular adjustment;

determining an amount of rotation of a middle adjustment sleeve of a first alignment adjustment system to implement to cause axial movement of an outer adjustment sleeve of the first alignment adjustment system relative to and inner adjustment sleeve of the first alignment adjustment system to achieve the change in distance; and automatically implementing the adjustments.

13. The method of claim 12, wherein the determining the amount of adjustment to implement by each of the alignment adjustment systems to be activated comprises determining the amount of adjustment to cause a change in angular alignment between a work spindle and the grind spindle.

14. The method of claim 12, wherein the determining an amount of adjustment to implement comprises:

determining an angular adjustment to achieve;

calculating a change in height to implement corresponding to the angular adjustment; and determining an amount of rotation to implement to achieve the change in height.

15. The method of claim 12, wherein the automatically implementing the adjustments comprises automatically activating a motor cooperated with the middle adjustment sleeve of the first alignment adjustment system to cause rotation of the middle adjustment sleeve the determined amount of rotation to achieve the change in distance between a grind spindle mounting plate and an upper bridge casting.

* * * * *